US011484905B1

(12) United States Patent
Burmester et al.

(10) Patent No.: US 11,484,905 B1
(45) Date of Patent: Nov. 1, 2022

(54) SPRAY NOZZLE CLAMP

(71) Applicant: NORDSON CORPORATION, Westlake, OH (US)

(72) Inventors: Thomas Burmester, Bleckede (DE); Sang Hyub Shin, Duluth, GA (US)

(73) Assignee: Nordson Corporation, Westlake, OH (US)

( * ) Notice: Subject to any disclaimer, the term of this patent is extended or adjusted under 35 U.S.C. 154(b) by 34 days.

(21) Appl. No.: 17/245,812

(22) Filed: Apr. 30, 2021

(51) Int. Cl.
*B05B 15/652* (2018.01)
*B05B 15/65* (2018.01)

(52) U.S. Cl.
CPC ..... *B05B 15/652* (2018.02); *B05B 15/65* (2018.02)

(58) Field of Classification Search
CPC ..... B05B 15/652; B05B 15/65
See application file for complete search history.

(56) References Cited

U.S. PATENT DOCUMENTS 4,613,078 A * 9/1986 Marshall ..... B05B 15/65 239/600
4,774,109 A * 9/1988 Hadzimihalis ..... B05C 5/027 118/410
4,781,252 A * 11/1988 Wilburn ..... A62C 3/06 169/68
5,389,151 A * 2/1995 Fort ..... B05C 5/027 118/411
7,699,243 B2 * 4/2010 Starke ..... B05C 5/0258 239/128
10,155,242 B2 * 12/2018 Burmester ..... G01F 15/006
11,148,167 B2 * 10/2021 Saine ..... B05C 19/008

* cited by examiner

*Primary Examiner* — Frederick C Nicolas
(74) *Attorney, Agent, or Firm* — BakerHostetler

(57) ABSTRACT

A nozzle clamp includes a body defining a first surface and an opposing second surface. The nozzle includes an arm pivotally connected to the body and configured to move between first and second positions. The arm includes a bore therethrough and a protrusion that is configured to contact the nozzle. The nozzle includes a fastener movable within the bore of the arm and configured to contact the second surface of the body. The clamp is movable between a first configuration and a second configuration. When the clamp is in the first configuration, the fastener is in contact with the second surface of the body, and the arm is precluded from being rotated relative to the body. When the clamp is in the second configuration, the fastener is not in contact with the second surface, and the arm is permitted to be pivoted relative to the body.

17 Claims, 11 Drawing Sheets

SPRAY NOZZLE CLAMP

TECHNICAL FIELD

The present invention relates to a clamp for a nozzle for an applicator assembly, the applicator assembly being configured for application of liquid material.

BACKGROUND

Applicator devices or systems are used for application of liquid material, for example hot melt adhesive, onto one or more substrates. Such applicator systems have a main body or housing, a nozzle assembly for dispensing the liquid material, and a dispensing assembly with a valve system for controlling the dispensing of material. The nozzle can be removed from the housing and cleaned, repaired, and/or replaced. The nozzle can be held in place by a clamping device.

The clamping device is typically attached to the housing and engages with the housing while the clamping device holds the nozzle in place. Such engagement by the clamping device with the nozzle can damage the housing, result in decreased clamping characteristics, clamping failure, and/or the like. This can change how the nozzle is positioned relative to the housing, can adversely affect material distribution, material dispensing, nozzle alignment, and/or the like.

SUMMARY

Disadvantages of the existing nozzle retention clamps and systems are overcome by the embodiments of one or more clamps disclosed herein. According to an aspect of this disclosure, a nozzle clamp that is configured to secure a nozzle to a housing of an applicator assembly includes a body defining a first surface configured to contact the housing and a second surface opposite the first surface. The nozzle further includes an arm pivotally connected to the body, the arm being configured to move between a first position and a second position relative to the body. The arm includes a bore extending therethrough and a protrusion extending therefrom, the protrusion being configured to contact the nozzle. The nozzle further includes a fastener movable within the bore of the arm, the fastener being configured to contact the second surface of the body. The nozzle clamp is movable between a first configuration and a second configuration. When the nozzle clamp is in the first configuration, the fastener is in contact with the second surface of the body, and the arm is precluded from being pivotally rotated relative to the body. When the nozzle clamp is in the second configuration, the fastener is not in contact with the second surface of the body, and the arm is permitted to be pivotally rotated relative to the body.

According to another aspect, an applicator assembly for applying a material to a substrate includes a housing, a dispensing assembly configured to receive the material from a material source and to cause discharging of the material therefrom, and a nozzle configured to be affixed to the housing, the nozzle further being configured to receive the material from the dispensing assembly and to discharge the material from the nozzle. The applicator assembly further includes a nozzle clamp configured to affix the nozzle to the housing. The nozzle clamp includes a body defining a first surface configured to contact the housing and a second surface opposite the first surface. The nozzle clamp further includes an arm pivotally connected to the body, the arm being configured to move between a first position and a second position relative to the body. The arm includes a bore extending therethrough and a protrusion extending therefrom, the protrusion being configured to contact the nozzle. The nozzle further includes a fastener movable within the bore of the arm, the fastener being configured to contact the second surface of the body. The nozzle clamp is movable between a first configuration and a second configuration. When the nozzle clamp is in the first configuration, the fastener is in contact with the second surface of the body, and the arm is precluded from being pivotally rotated relative to the body. When the nozzle clamp is in the second configuration, the fastener is not in contact with the second surface of the body, and the arm is permitted to be pivotally rotated relative to the body.

BRIEF DESCRIPTION OF THE DRAWINGS

The present application is further understood when read in conjunction with the appended drawings. For the purpose of illustrating the subject matter, there are shown in the drawings exemplary aspects of the subject matter; however, the presently disclosed subject matter is not limited to the specific methods, devices, and systems disclosed. In the drawings.

Aspects of the disclosure will now be described in detail with reference to the drawings, wherein like reference numbers refer to like elements throughout, unless specified otherwise.

DETAILED DESCRIPTION OF ILLUSTRATIVE EMBODIMENTS

Figure 1:
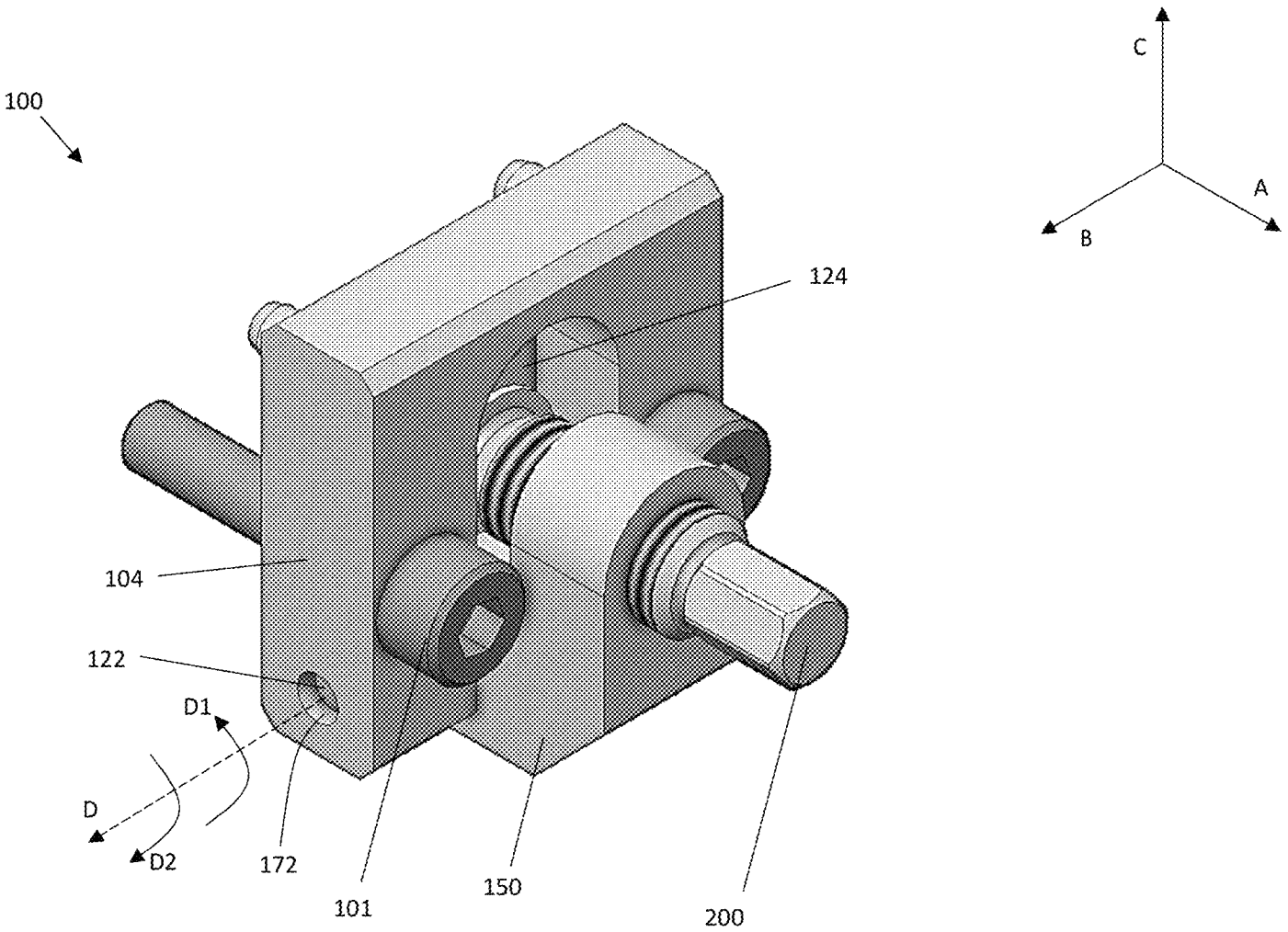
FIG. 1 depicts an isometric view of a nozzle clamp according to an aspect of this disclosure.
Figure 2:
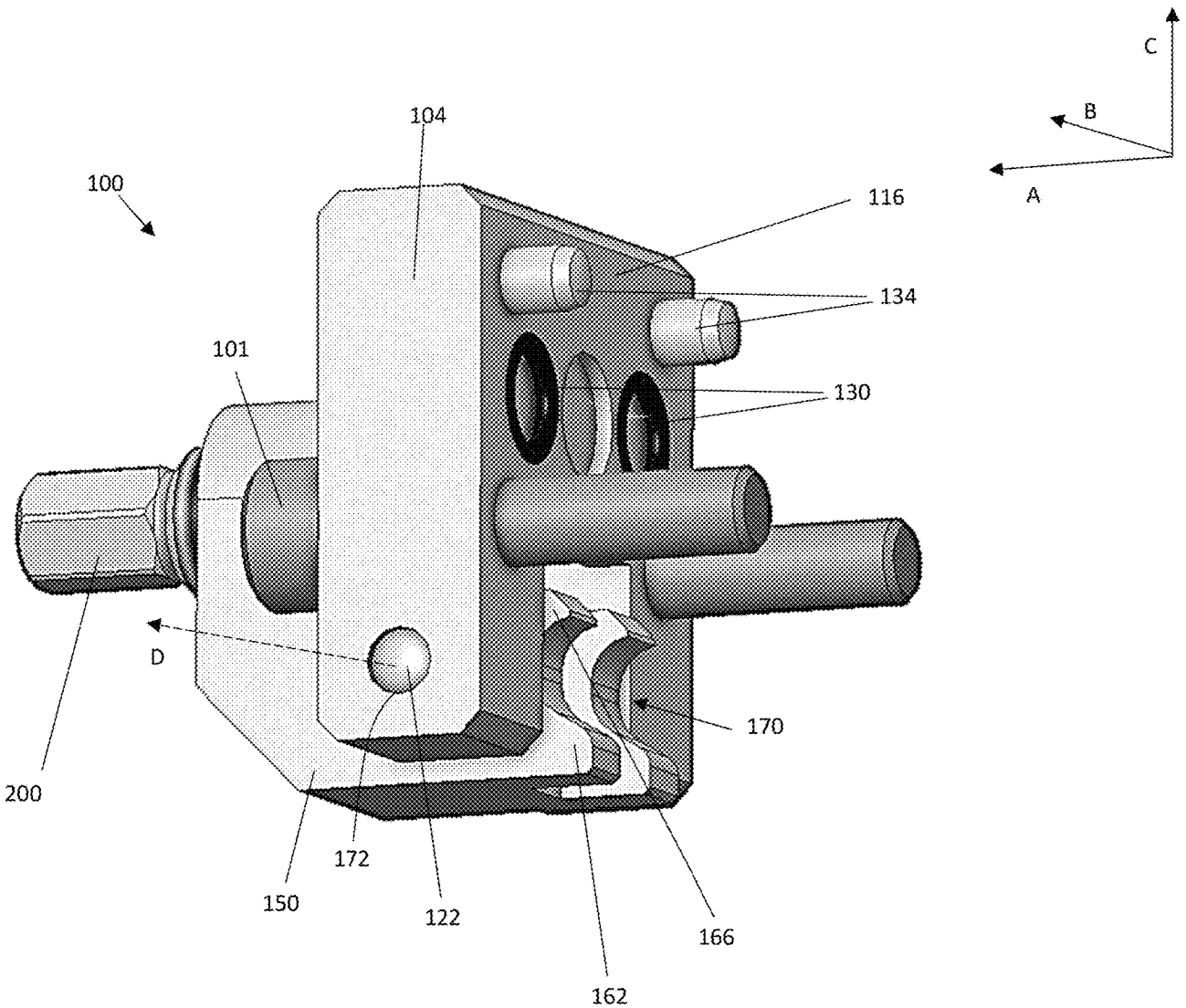
FIG. 2 depicts another perspective view of the nozzle clamp of FIG. 1.
Figure 3:
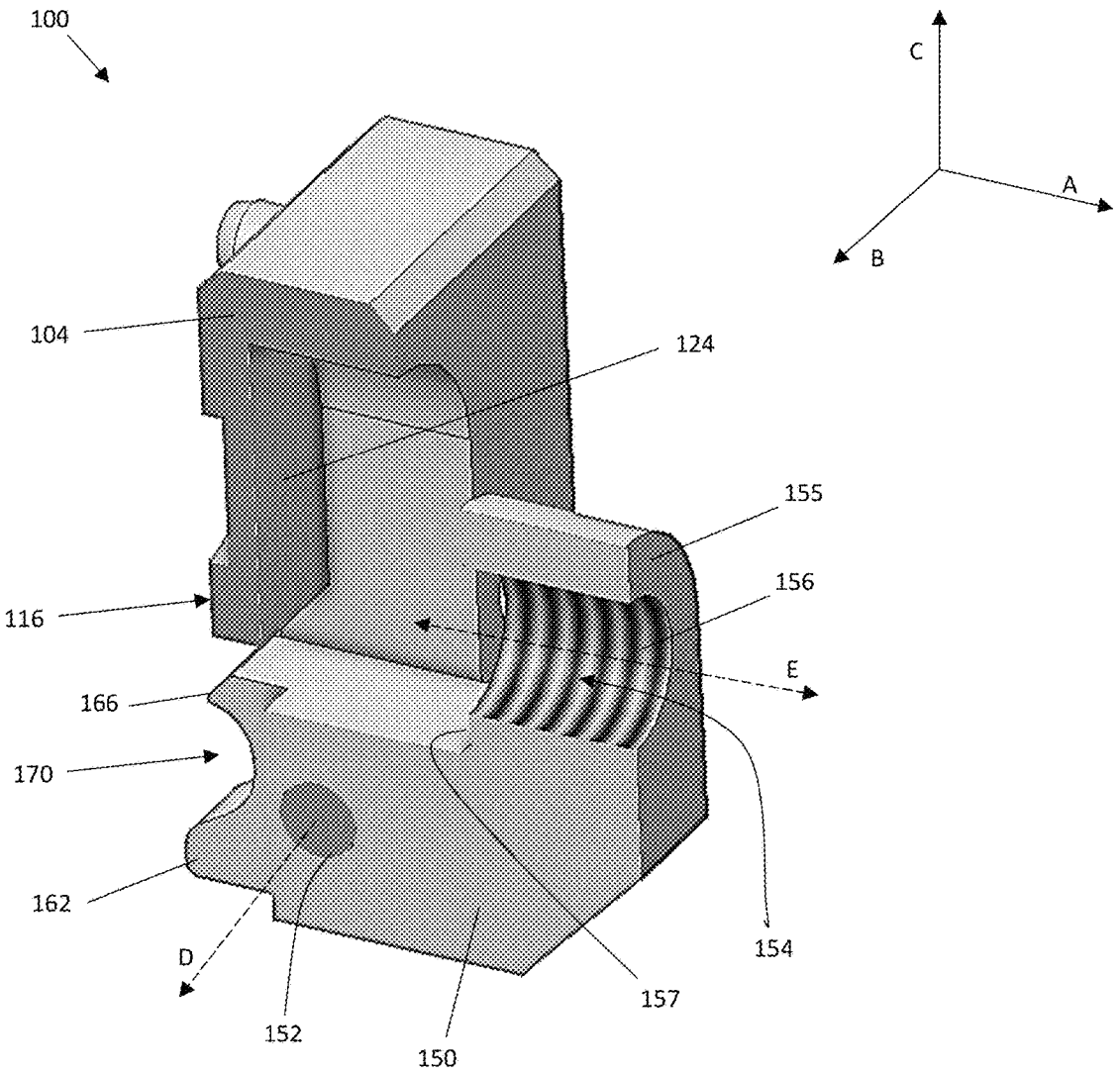
FIG. 3 depicts a cross-sectional perspective view of the nozzle clamp of FIG. 1 without illustration of an associated fastener.

Referring to FIGS. 1-3, a clamp 100 is depicted having a body 104 and an arm 150 configured to be pivotally moved relative to the body 104. The clamp 100 may be configured to releasably affix a nozzle to an applicator assembly, as will be described in detail below in conjunction with FIGS. 9-11. The body 104 may include a back wall 116 configured to contact the applicator assembly as illustrated in FIG. 2. For purposes of this disclosure, reference will be made to various axes and directions with respect to the described components. It should be appreciated that the described coordinates are for reference purposes only, and that this disclosure is not limited to the particular axes, directions, or planes described. A first axis A is defined as extending substantially orthogonal to the back wall 116 of the body 104. A second axis B extends orthogonal to the first axis A. A third axis C extends orthogonal to the first axis A and the second axis B. Thus, a plane defined by the first axis A and the second axis B will be orthogonal to the third axis C; a plane defined by the first axis A and the third axis C will be orthogonal to the second axis B; and a plane defined by the second axis B and the third axis C will be orthogonal to the first axis A. For purposes of this disclosure, reference to one or more directions along the first, second, and/or third axes A, B, and C will include both opposing directions unless indicated otherwise. That is, for example, reference to a direction along the first axis A will include a direction along the first axis A from a first point toward a second point and also a direction from the second point toward the first point. Furthermore, reference to directions along the one or more of the first, second, and third axes A, B, and C can include directions that overlay the reference axis and directions that are offset from the references axis but that are substantially parallel to the reference axis. For example, reference to a direction along the first axis A can include a direction that overlays the first axis A or to a direction that is offset and parallel to the first axis A.

A front wall 124 is defined on the body 104 opposite the back wall 116. The front wall 124 is spaced along the first axis A from the back wall 116. A surface of the front wall 124 may be parallel to a surface of the back wall 116. Additionally, the body 104 may include side surfaces extending between the front wall 124 and the back wall 116. The arm 150 may be movably attached to the body 104. At least a portion of the arm 150 may be disposed opposite the front wall 124 along the first axis A. In some aspects, the arm 150 can be pivotally connected to the body 104, such that the arm 150 can be moved toward and/or away from the front wall 124. The body 104 and/or the arm 150 may include a pin 122 extending therefrom or therethrough. The arm 150 may include an aperture 152 configured to receive the pin 122 therein. In particular, the aperture 152 may be defined by surfaces arranged within the arm 150 configured to receive the pin 122. The pin 122 may have a press-fit configuration with respect to the aperture 152. Additionally, the body 104 may include an aperture 172 configured to receive the pin 122 therein. In particular, the aperture 172 may be defined by surfaces arranged within the body 104 configured to receive the pin 122. The pin 122 may have a press-fit configuration with respect to the aperture 172. The arm 150 may be rotatable around a pivot axis D defined through the pin 122 and the aperture 152. The pivot axis D may be parallel to the second direction B. The arm 150 may be configured to pivot around the pivot axis D in a first direction D1 and/or in a second direction D2 opposite the first direction D1. When the arm 150 is pivoted in the first direction D1, at least a portion of the arm 150 is moved towards the front wall 124. When the arm 150 is pivoted in the second direction D2, at least the portion of the arm 150 is moved away from the front wall 124.

In some aspects, the body 104 may include two pins 122 on either side of the arm 150, with one of the pins 122 being spaced from the other one of the pins 122 along the second axis B. The arm 150 may include two apertures 152, with one of the apertures 152 being spaced from the other aperture 152 along the second axis B, such that each implementations of the aperture 152 may be configured to receive one of the pins 122 therein. Likewise, the body 104 may include two apertures 172, with one of the apertures 172 being spaced from the other aperture 172 along the second axis B, such that each implementations of the aperture 172 may be configured to receive one of the pins 122 therein. It will be understood that other pin and aperture arrangements are envisioned, for example, ones where one or more of the pins 122 are disposed on the arm 150 and one or more of the respective ones of the apertures 152 are disposed on the body 104.

The arm 150 can define a bore 154 therethrough configured to receive therein a fastening element. At least a portion of the bore 154 may be disposed opposite the front wall 124 along the first axis A. The bore 154 may be defined between a first end 155 and a second end 157 spaced from the first end 155. The first end 155 and the second end 157 may define surfaces that are parallel to surfaces of the front wall 124 and the back wall 116. A bore axis E can be defined through the bore 154 and extend between the first end 155 and the second end 157. In some positions of the arm 150, the bore axis E can be substantially parallel to the first axis A. When the arm 150 is pivotally moved about the pin 122, the bore axis E can be angularly offset from the first axis A. The bore axis E can be orthogonal to the pivot axis D.

In some aspects, the fastening element may include a screw, a fastener, a bolt, and/or the like hereinafter referred to as a bolt 200. The bolt 200 may be translationally movable through the bore 154 along the bore axis E. The bolt 200 can be moved in directions towards and away from the front wall 124. The bolt 200 may be rotatable within the bore 154 around the bore axis E in both rotational directions around the axis in order to be moved towards and away from the front wall 124.

Figure 4:
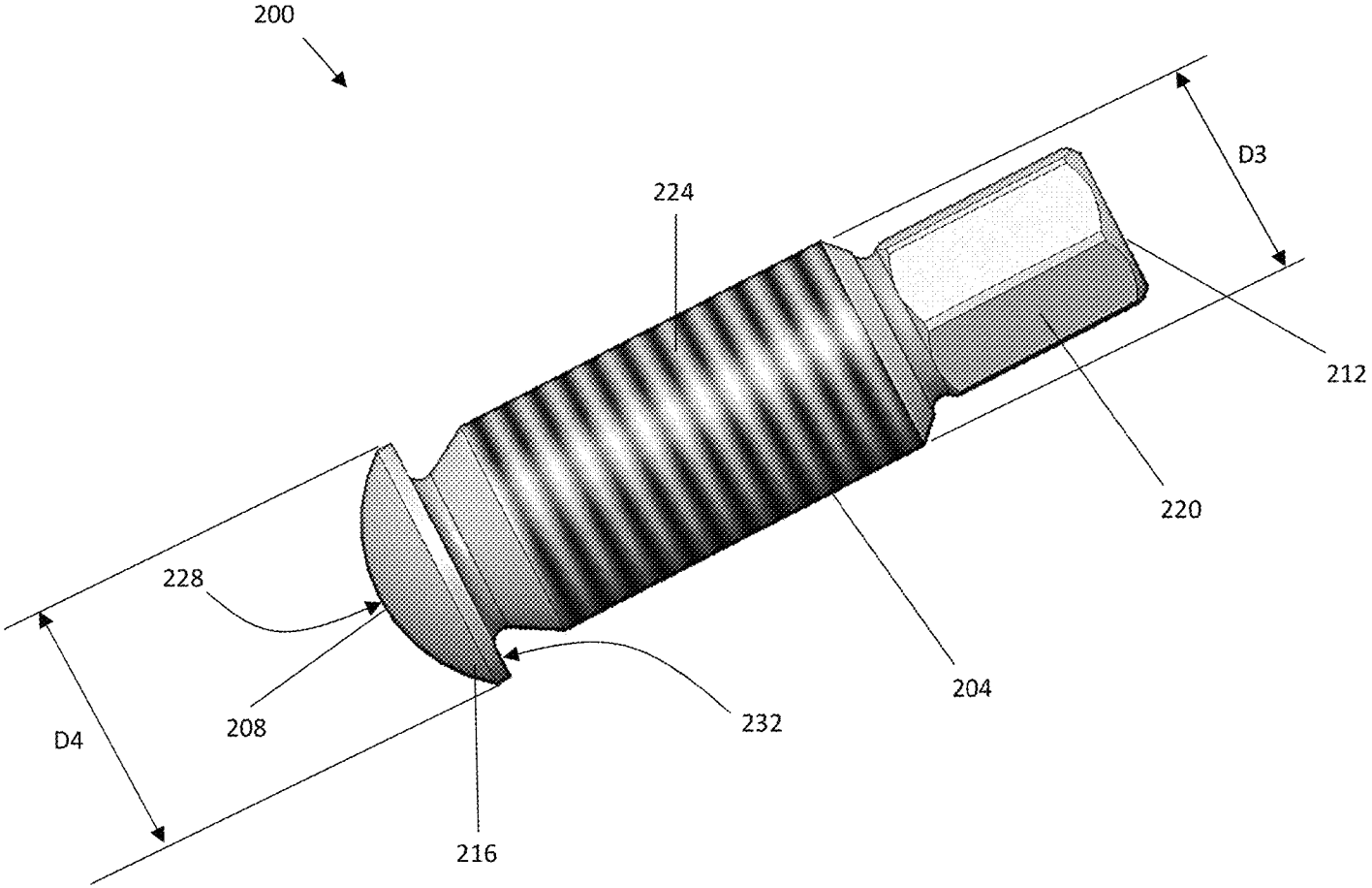
FIG. 4 depicts a fastener according to an aspect of this disclosure.

With continued reference to FIGS. 1 and 2 and with further reference to FIG. 4, the bolt 200 may have a first end 208 and a second end 212 opposite the first end 208. The bolt 200 may include a tool interface 220 thereon configured to engage with a tool (not shown). The tool interface 220 may be adjacent the second end 212. The tool interface 220 may be configured to be engaged with a tool to cause the bolt 200 to translate along the bore 154, rotate within the bore 154, both translate and rotate relative to the bore 154 and/or the like. In some aspects, the tool interface 220 may define a geometric shape that corresponds to a geometric shape of a suitable tool, such as triangular, rectangular, pentagonal, hexagonal, octagonal, or another suitable shape. The bolt 200 may be configured to be actuated with a driver, a wrench, or another suitable tool, and this disclosure is not limited to any particular tool or respective shape of the tool interface 220. In some aspects, the tool interface 220 may be contacted and/or manipulated by a user directly without a separate tool. For example, in some aspects, the user can use his or her hand to translate and/or rotate the bolt 200 relative to the bore 154. In this regard, the tool interface 220 may include a handle or other surface for direct user operation.

The bolt 200 may include a head 216 adjacent the first end 208. The head 216 may define a contact surface 228 at one end thereof. The contact surface 228 may be at, or adjacent to, the first end 208. The contact surface 228 may be configured to be selectively moved into and/or out of contact with the front wall 124 of the body 104 of the clamp 100 when the bolt 200 is moved towards or away from the front wall 124.

A retention surface 232 may be defined on the head 216 opposite the contact surface 228. The retention surface 232 may be configured to contact the arm 150 when the bolt 200 is moved through the bore 154 away from the body 104. The contact between the retention surface 232 and the arm 150 may preclude the bolt 200 from being moved beyond a desired distance relative to the bore 154, and may preclude the bolt 200 from being removed entirely from the bore 154.

The bolt 200 may include an intermediate segment 204 disposed between the first end 208 and the second end 212. The intermediate segment 204 may be disposed between the head 216 and the tool interface 220. In some aspects, the intermediate segment 204 may include threads 224 thereon. The threads 224 may be configured to engage with corresponding threads 156 defined on the bore 154 (labeled in FIG. 3). In one or more aspects, the bolt 200 may be configured as a male component and the bore 154 as a female component. The intermediate segment 204 may have a cross-sectional dimension D3. In some aspects, the cross-sectional dimension D3 may be a diameter D3.

The head 216 may have a cross-sectional dimension D4. In some aspects, the cross-sectional dimension D4 may be a diameter D4. The diameter D4 of the head 216 may be greater than the diameter D3 of the intermediate segment 204. The bolt 200 may be translatable through the bore 154 between the retention surface 232 on the head 216 and the second end 212 of the bolt 200. As such, the head 216 may be precluded from entering the bore 154. This may be advantageous to prevent the bolt 200 from inadvertently being fully separated from the clamp 100.

Figure 5:
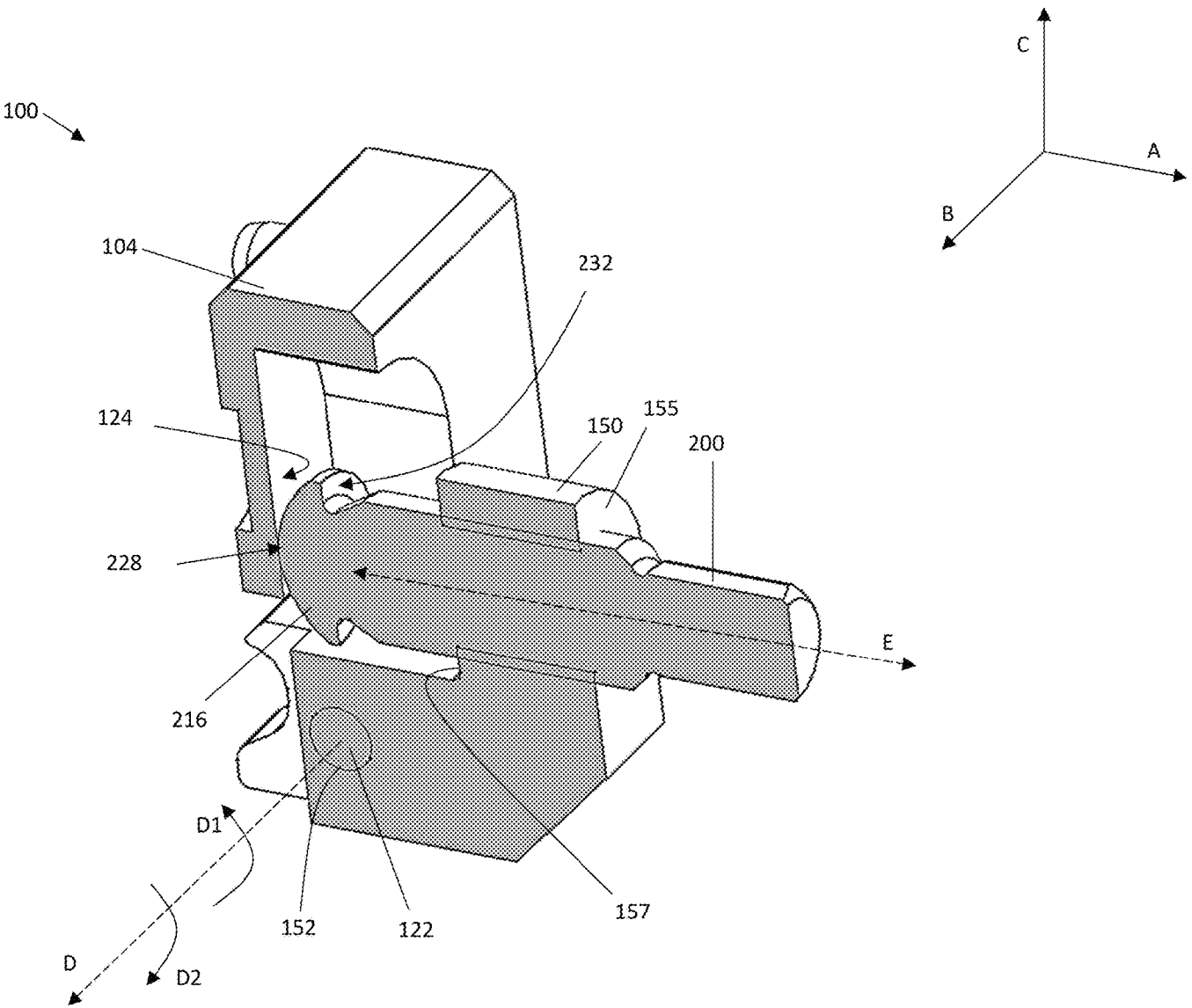
FIG. 5 depicts a cross-sectional perspective view of the nozzle clamp of FIG. 1 shown in a first configuration according to an aspect of this disclosure.

The clamp 100 may be configured to have a first configuration, in which the nozzle is retained with respect to the housing of the applicator assembly, and a second configuration, in which the nozzle is not retained with respect to the housing. Referring to FIG. 5, a cross-sectional view of the clamp 100 in the first configuration is depicted. In this configuration, the bolt 200 is translated along the bore axis E towards the body 104 of the clamp 100 until the bolt 200 contacts the front wall 124 to place the clamp 100 in the first configuration. In this figure, the bore axis E can be substantially parallel to the first axis A. Specifically, the contact surface 228 of the head 216 may be configured to contact the front wall 124 of the body 104. At this point, the bolt 200 is disposed in its farthest position relative to the arm 150 along the bore axis E, i.e., this is the greatest distance between the second end 157 of the bore 154 and the head 216 of the bolt 200 when the bolt 200 is within the bore 154. This can be referred to as the maximum insertion position of the bolt 200. In this arrangement, the bolt 200 can be secured to the arm 150 (e.g., via the threads 224 on the bolt 200 and the corresponding threads 156 on the interior of the bore 154). When the bolt 200 is in contact with the front wall 124, the arm 150 is precluded from pivoting about the pivot axis D in at least one direction. For example, the arm 150 can be precluded from pivoting about the pivot axis D along the direction D1 towards the front wall 124. This is due to the bolt 200 contacting the front wall 124 and physically blocking movement in this direction.

Figure 6:
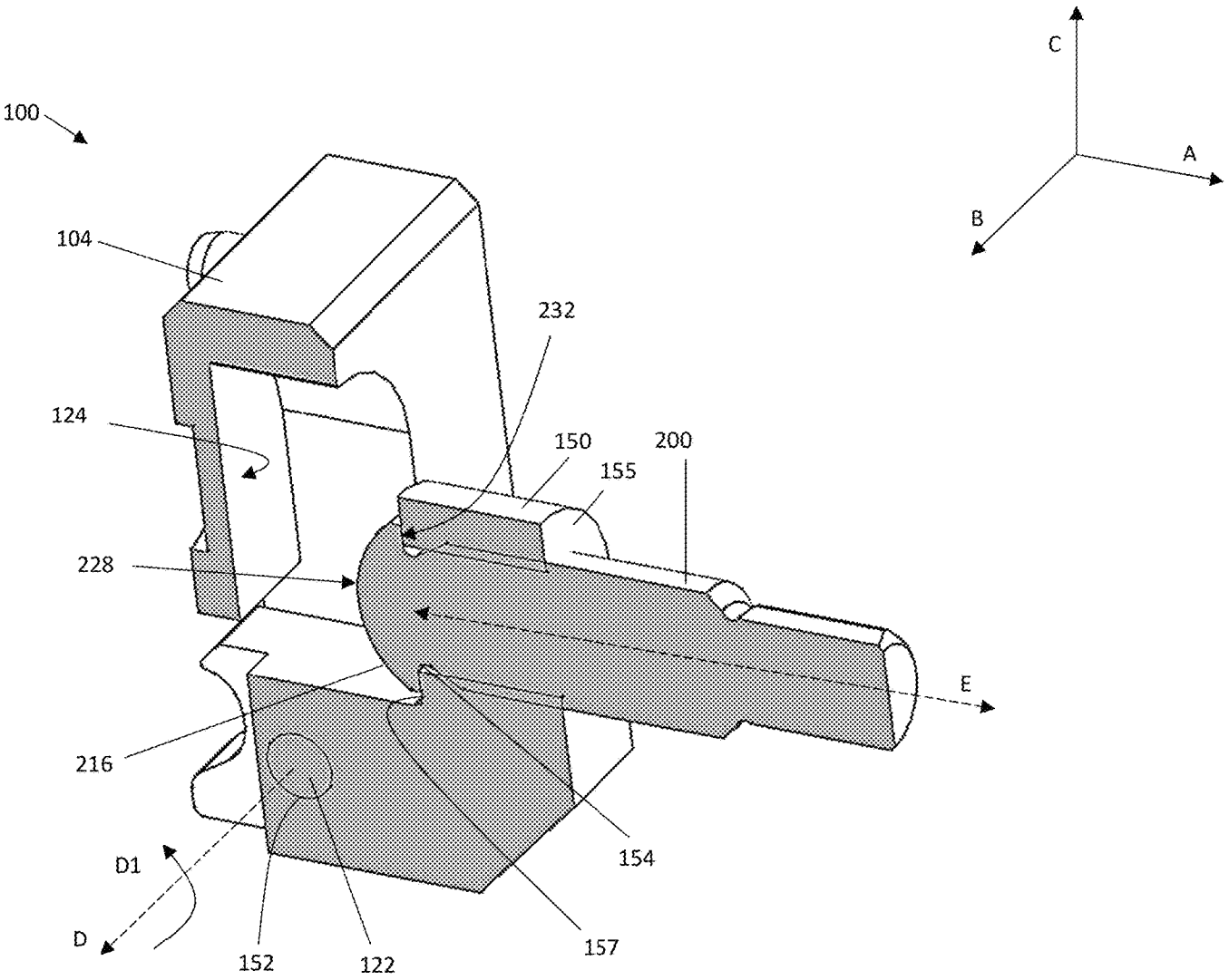
FIG. 6 depicts a cross-sectional perspective view of the nozzle clamp of FIG. 1 shown being transitioned between the first configuration and a second configuration.

Referring to FIG. 6, the bolt 200 is shown having been moved through the bore 154 along the bore axis E away from the front wall 124. The head 216 may be configured to contact the arm 150 adjacent the bore 154. The retention surface 232 may contact the arm 150 at the second end 157 of the bore 154 to preclude the head 216 from entering the bore 154. In this figure, the bolt 200 is shown in its farthest position within the bore 154 in the direction toward the first end 155 of the bore 154 along the bore axis E. This can be referred to as the maximum extraction position of the bolt 200. The bolt 200 may be movable to any position between the maximum insertion position shown in FIG. 5 above and the maximum extraction position shown in FIG. 6 here. Because the contact surface 228 of the head 216 is no longer in contact with the front wall 124 of the body 104, the arm 150 is not precluded from being rotated about the pivot axis D in the direction D1 toward the front wall 124. In this position, a user may actuate rotation of the arm 150 in the direction D1 by applying a force to the arm 150 along the first axis A towards the front wall 124 to place the clamp 100 and the second configuration.

Figure 7:
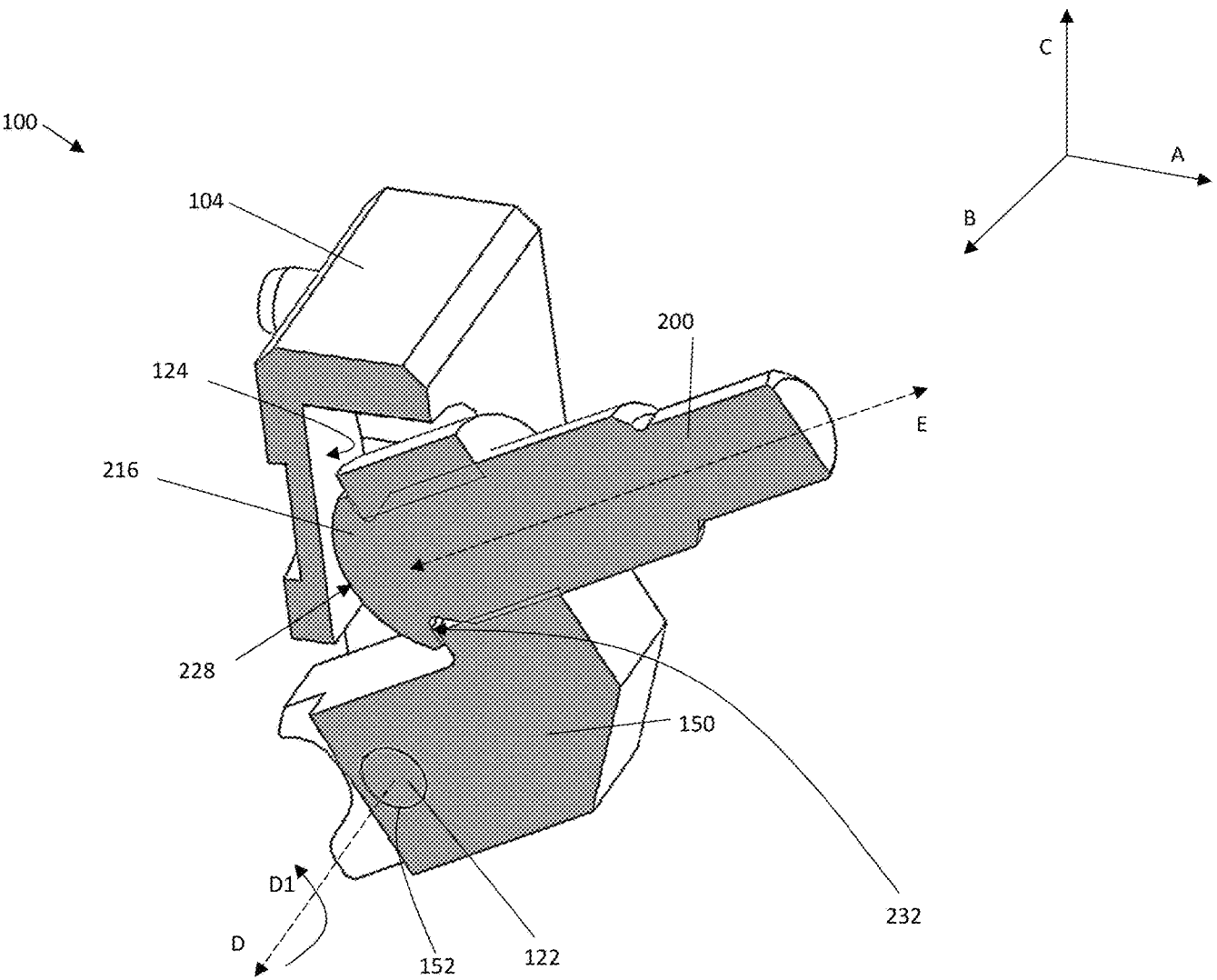
FIG. 7 depicts a cross-sectional perspective view of the nozzle clamp of FIG. 1 shown in the second configuration.

Referring to FIG. 7, the clamp 100 is shown in the second configuration, where the arm 150 has been pivoted along the first rotational direction D1 towards the front wall 124. The distance that the arm 150 may be pivoted from the first configuration to the second configuration may depend on the distance between the front wall 124 and the head 216 of the bolt 200, the distance between the front wall 124 and the arm 150 (e.g., a portion of the arm 150 adjacent the second end 157 of the bore 154), or between another portion of the body 104 and a portion of the arm 150 and/or the bolt 200. The arm 150 can be pivoted in the first rotational direction D1 until further movement is precluded by contact between one or more components of the body 104 and one or more components of the arm 150 and/or the bolt 200. In some aspects, the distance that the arm 150 can be pivoted along the first rotational direction D1 can be controlled by the distance that the bolt 200 is moved along the bore axis E away from the front wall 124. For example, when the bolt 200 is moved to its maximum extraction position along the bore 154 away from the front wall 124 (see FIG. 6), this can correspond to a maximum distance of pivoting of the arm 150 in the direction D1. The bolt 200 may be moved along the bore axis E to a position between its maximum inserted position (shown in FIG. 5) and its maximum extracted position (shown in FIGS. 6 and 7). Accordingly, when the bolt 200 is not at its maximum extracted position, the distance that the arm 150 can pivot in the direction D1 can be proportionally less than when the bolt 200 is in its maximum extracted position.

Referring again to FIGS. 2 and 3, the clamp 100 can include a nozzle engagement interface configured to releasably contact the nozzle of the applicator assembly. The engagement interface may include a first protrusion 162 that may extend from the arm 150. The first protrusion 162 may be movable when the arm 150 is moved around the pivot axis D. The first protrusion 162 can be any suitable shape or dimension and should be configured to contact a portion of the nozzle, as will be described below. In some aspects, the engagement interface may include a second protrusion 166 that may extend from the arm 150. The second protrusion 166 may be, at least partly, parallel to the first protrusion 162. The second protrusion 166 may be configured to contact another portion of the nozzle, as will be described below. A recess 170 may be defined between the first protrusion 162 and the second protrusion 166 and be configured to receive the nozzle therein.

Figure 8:
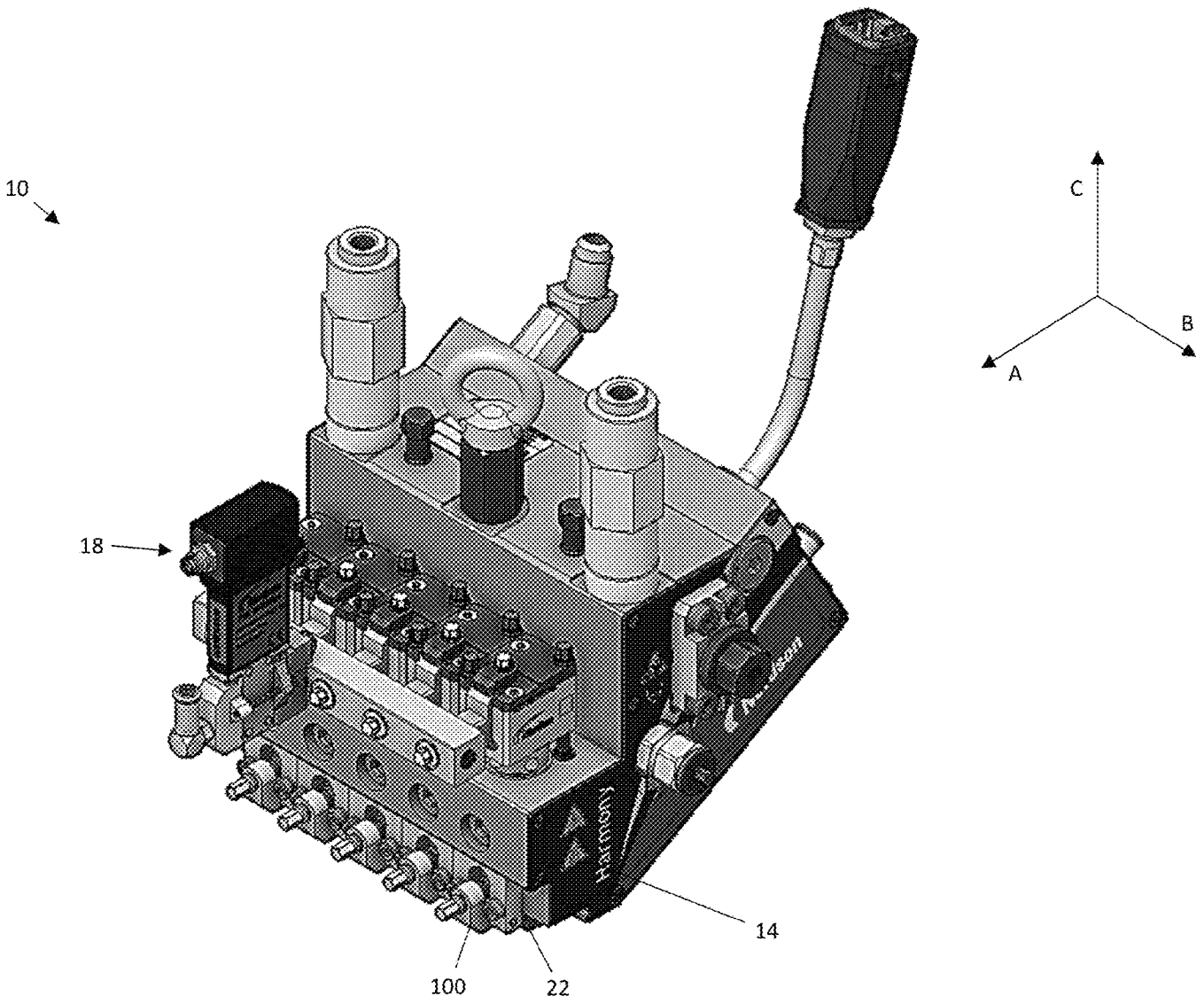
FIG. 8 depicts an isometric view of an applicator assembly according to an aspect of this disclosure.

Turning to FIGS. 8-11, an exemplary implementation of the applicator assembly 10 is shown having a housing 14. One or more dispensing assemblies 18 can be disposed on, or in, the housing 14. The one or more dispensing assemblies 18 may be configured to receive an application material from a source (not shown) and to guide the application material to one or more connected arrangements of the nozzles 22. The application material can pass through the nozzles 22 and be dispensed onto a suitable substrate (not shown). Each nozzle 22 can be retained relative to the housing 14 by a clamp 100, such as described above. In some aspects, the applicator assembly 10 can include a single implementation of one of the dispensing assemblies 18 and a single implementation of the nozzle 22 held by a single implementation of the clamp 100. In other aspects, the applicator assembly 10 can include a plurality of dispensing assemblies 18, a plurality of the clamp 100, and a plurality of the nozzles 22. The plurality of dispensing assemblies 18, the clamp 100, and the nozzles 22 can be arranged side by side in a serial manner, for example, along the second axis B as shown in FIG. 8. Each nozzle 22 can be affixed to the housing 14 with an individual configuration of the clamp 100. Alternatively, a plurality of the nozzle 22 may be held by a single implementation of the clamp 100.

Figure 9:
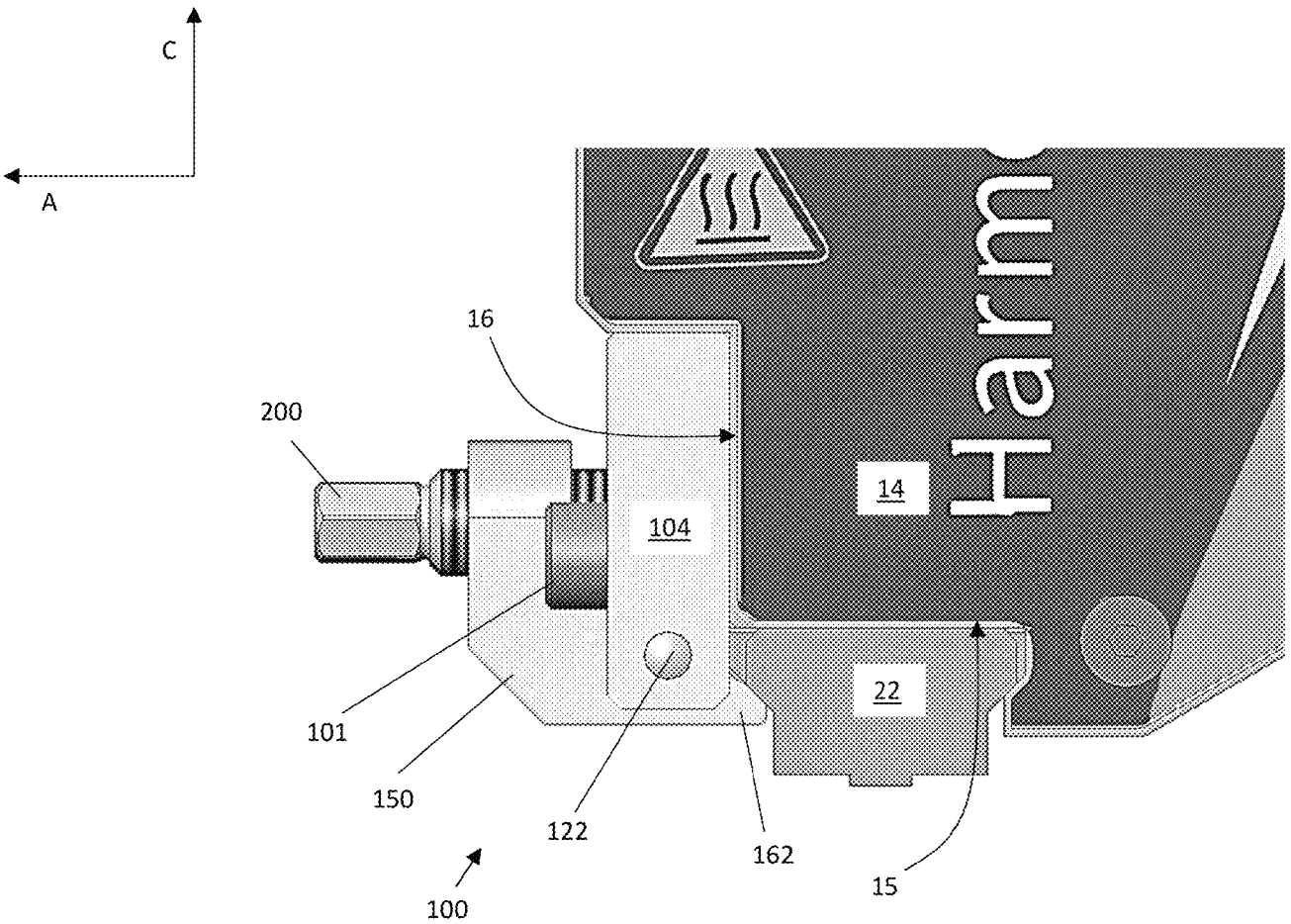
FIG. 9 depicts a side view of the applicator assembly of FIG. 8 with the nozzle clamp being in the first configuration.

FIGS. 8 and 9 depict a nozzle 22 that is secured to the housing 14 via a clamp 100. The clamp 100 is in the first configuration. The nozzle 22 may be held securely against the housing 14 at a nozzle contact surface 15. The nozzle contact surface 15 may be arranged below the housing 14 of the applicator assembly 10. It is important that the nozzle 22 be securely affixed to the nozzle contact surface 15 to ensure that the application material is properly discharged from the dispenser assembly 18 into the nozzle 22. The clamp 100 can be affixed to the housing 14 at a clamp surface 16. The clamp 100 can be affixed to the housing 14 via one or more fasteners 101. The fasteners 101 may be any suitable fasteners, such as bolts, screws, clamps, and/or the like. The fasteners 101 can extend through the body 104, or otherwise secure the body 104, and releasably connect with the housing 14. The back wall 116 of the body 104 may be configured to be securely in contact with the clamp surface 16 of the housing 14 when the clamp 100 is affixed to the housing 14.

When the nozzle 22 is held against the nozzle contact surface 15 and the clamp 100 is in the first configuration, the nozzle 22 may be precluded from movement away from the nozzle contact surface 15. The first protrusion 162 on the clamp 100 may be configured to contact the nozzle 22 and apply a clamping force to the nozzle 22 along the third axis C towards the nozzle contact surface 15. This secures the nozzle 22 to the nozzle contact surface 15 and precludes the nozzle 22 from being moved away from the nozzle contact surface 15.

Figure 10:
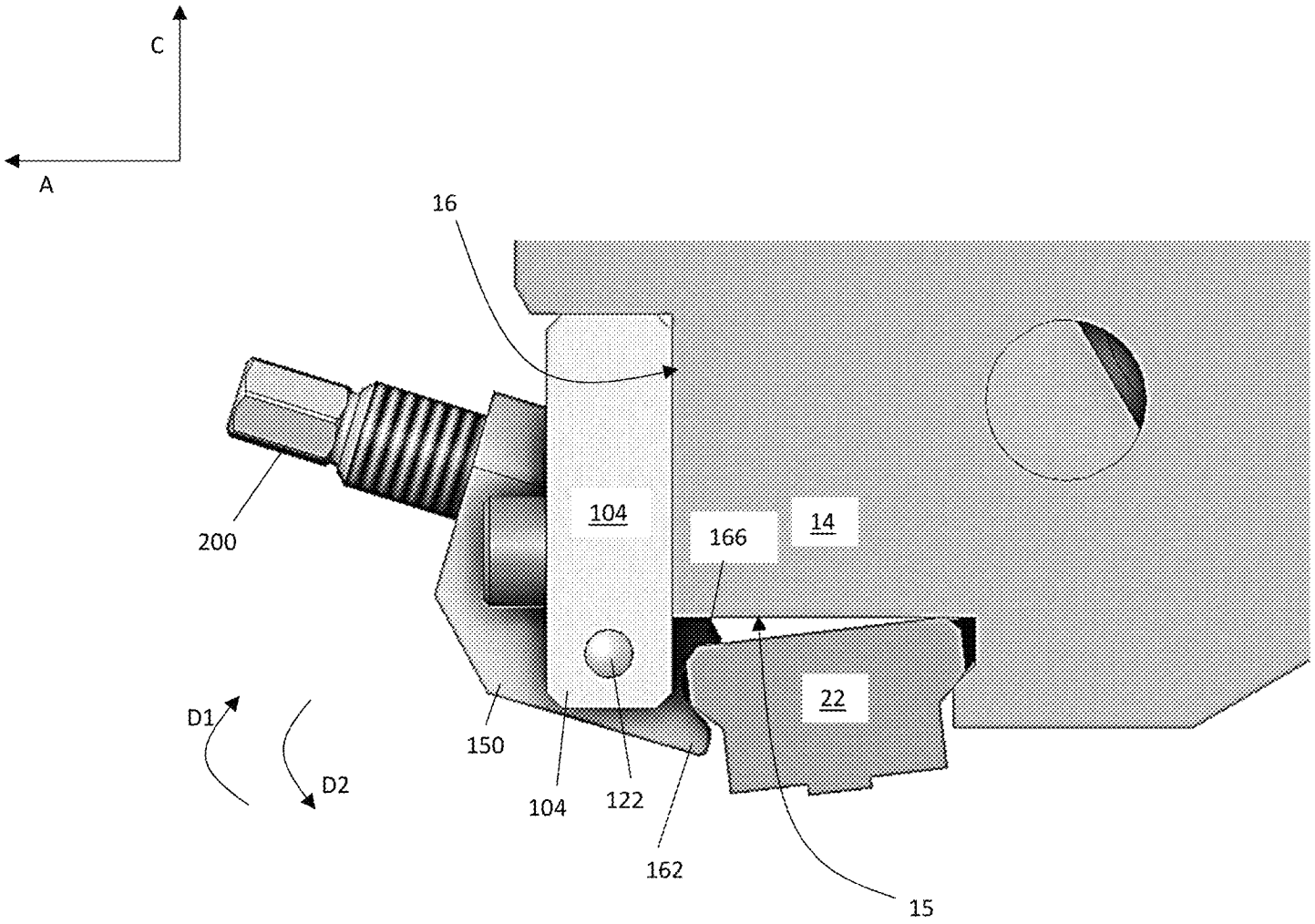
FIG. 10 depicts a side cross-sectional view of the applicator assembly of FIG. 8 with the nozzle clamp in the second configuration.
Figure 11:
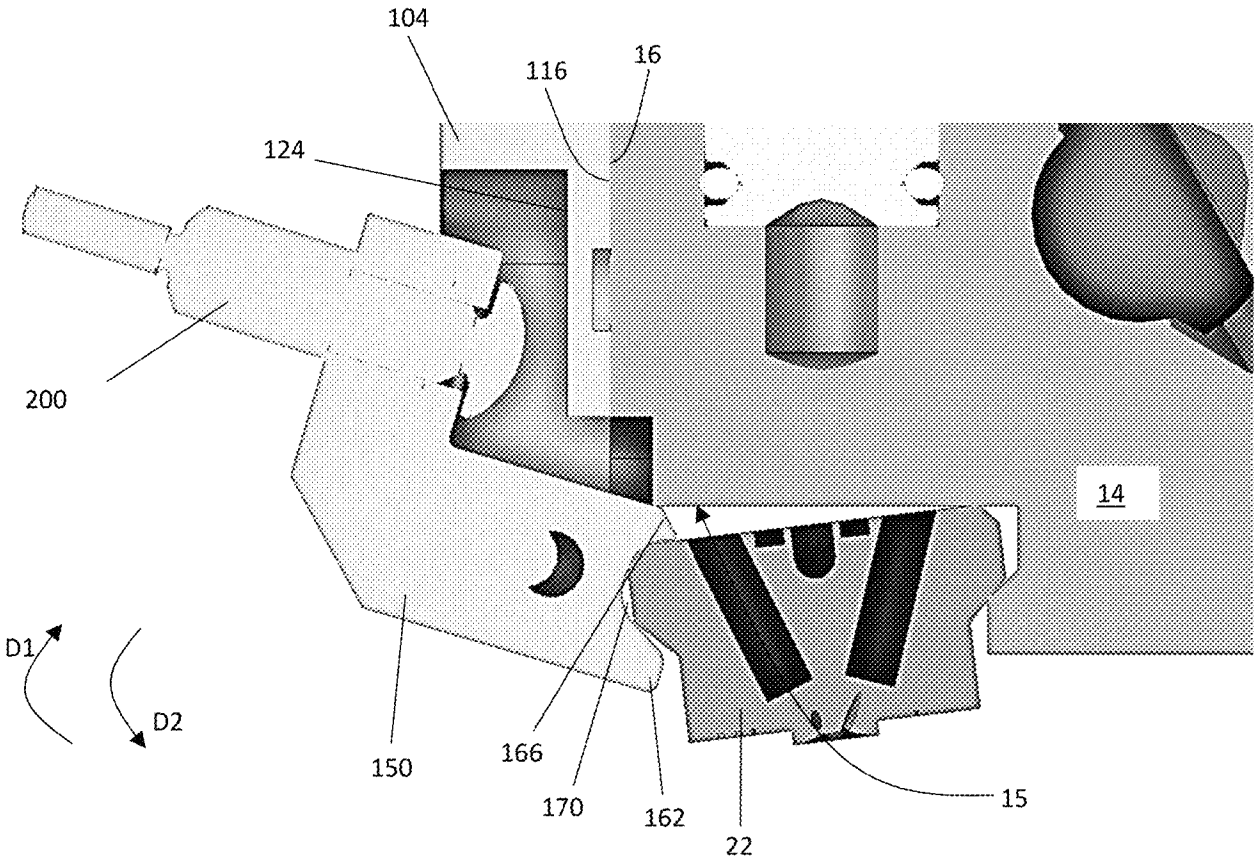
FIG. 11 depicts a side cross-sectional view of the applicator assembly of FIG. 8 with the nozzle clamp in the second configuration.

To release the nozzle 22 from the housing 14, the clamp 100 can be moved to the second configuration as described above. Referring to FIGS. 10 and 11, the clamp 100 is shown in the second configuration. As the arm 150 is pivoted to move the clamp 100 to the second configuration, the first protrusion 162 is moved away from the nozzle 22. When the first protrusion 162 is moved away from the nozzle 22, the first protrusion 162 no longer applies a clamping force onto the nozzle 22 towards the nozzle contact surface 15. At this time, the nozzle 22 is no longer secured to the housing 14 and can be moved relative to the housing 14 or removed from the applicator assembly 10.

In some aspects, the clamp 100 can include the second protrusion 166 disposed on the arm 150. When the clamp 100 is moved to the second configuration, the second protrusion 166 contacts the nozzle 22 and applies a force to the nozzle 22 away from the nozzle contact surface 15. This can apply force to the nozzle 22 and cause the nozzle 22 to release from the nozzle contact surface 15 and can facilitate disengagement and removal of the nozzle 22 from the housing 14. The nozzle 22 can be disposed in the recess 170 defined between the first protrusion 162 and the second protrusion 166. When the clamp 100 is in the second configuration, the nozzle 22 may still be retained in the recess 170 even though the nozzle 22 is spaced from the nozzle contact surface 15. This can facilitate locating and removing the nozzle 22 and avoid the nozzle 22 falling away from the housing 14 due to gravity once the nozzle 22 is no longer clamped to the housing 14. This can also facilitate introducing a different or a new configuration of the nozzle 22 by providing a space for the nozzle 22 to be placed before affixing it to the housing 14.

To affix a nozzle 22 to the housing 14, the nozzle 22 may be arranged in the recess 170 when the clamp 100 is in the second configuration. The clamp 100 can then be moved to the first configuration by rotating the arm 150 in a second rotational direction D2 opposite the first rotational direction D1 until the nozzle 22 fully contacts the nozzle contact surface 15 and the first protrusion 162 rigidly pushes against the nozzle 22 along the third axis C towards the nozzle contact surface 15. To secure the clamp 100 in the first configuration, the bolt 200 can be moved to its maximum insertion position as described earlier.

When the bolt 200 is in its maximum insertion position, the head 216 of the bolt 200 contacts the front wall 124 at the contact surface 228 on the head 216 of the bolt 200. The front wall 124 may include sturdy metallic portions such as steel and may be precluded from being damaged by repetitive contact of the head 216 of the bolt 200. The bolt 200 may be configured to only contact the front wall 124 of the clamp 100 and not contact the housing 14 directly. This configuration avoids and/or reduces the likelihood of damaging the surface of the housing 14. If the bolt 200 contacts the housing 14, the repeated contacting can cause damage to the structure of the housing 14 and can cause dents, notches, and/or like damage to be formed on the housing 14. The formation of such dents or notches would increase the necessary insertion distance of the bolt 200 to effectively retain the clamp 100 in the first configuration. Over time, such dents would result in the clamp 100 being moved out of the first configuration earlier than desired, which would release the clamping force from the first protrusion 162 onto the nozzle 22 towards the nozzle contact surface 15. This can result in the nozzle 22 not being rigidly affixed to the nozzle contact surface 15 as desired and can result in material leaking out between the housing 14 and the nozzle 22 and/or in undesirable pressure changes as the material is being moved towards and through the nozzle 22. This can result in undesired discharging effects of the material onto the substrate. Moreover, this may result in possible misalignment of the nozzle 22.

In the embodiments of the clamp 100 disclosed herein, the clamp 100 includes a front wall 124 that is configured to be contacted by the bolt 200. The front wall 124 can include a harder material than the rest of the housing 14, for example, steel. The steel configurations of the front wall 124 do not wear as quickly or as easily as the material of the housing 14, and thus dents and/or other damage are substantially avoided due to repeated contact and forces exerted by the bolt 200 when the clamp 100 is in the first configuration.

In some aspects, the clamp 100 may include one or more seals 130 disposed on the back wall 116. The one or more seals 130 may be configured to sealingly engage with corresponding air inlet holes (not shown) on the housing 14. The body 104 of the clamp 100 may include one or more studs or dowels 134 configured to be received into complementary apertures (not shown) on the housing 14 to facilitate alignment of the clamp 100 with the housing 14.

While systems and methods have been described in connection with the various embodiments of the various figures, it will be appreciated by those skilled in the art that changes could be made to the embodiments without departing from the broad inventive concept thereof. It is understood, therefore, that this disclosure is not limited to the particular embodiments disclosed, and it is intended to cover modifications within the spirit and scope of the present disclosure as defined by the claims.

What is claimed:

1. A nozzle clamp configured to secure a nozzle to a housing of an applicator assembly, the nozzle clamp comprising:

a body defining a first surface configured to contact the housing and a second surface opposite the first surface;

an arm pivotally connected to the body, the arm being configured to move between a first position and a second position relative to the body, the arm comprising:

a bore extending therethrough; and a protrusion extending therefrom, the protrusion being configured to contact the nozzle; and a fastener movable within the bore of the arm, the fastener being configured to contact the second surface of the body, wherein the nozzle clamp is movable between a first configuration and a second configuration, wherein when the nozzle clamp is in the first configuration, the fastener is in contact with the second surface of the body, and the arm is precluded from being pivotally rotated relative to the body, and wherein when the nozzle clamp is in the second configuration, the fastener is not in contact with the second surface of the body, and the arm is permitted to be pivotally rotated relative to the body.

2. The nozzle clamp of claim 1, wherein the nozzle clamp comprises steel.

3. The nozzle clamp of claim 1, wherein the fastener includes threads thereon, and the bore includes complementary threads therein, the threads on the fastener being configured to engage with the threads on the bore.

4. The nozzle clamp of claim 1, wherein the protrusion on the arm is a first protrusion, and the arm includes a second protrusion spaced from the first protrusion, the second protrusion being configured to contact the nozzle.

5. The nozzle clamp of claim 1, wherein the bore defines a first cross-sectional diameter, the fastener defines a second cross-sectional diameter, and the second cross-sectional diameter is less than the first cross-sectional diameter.

6. The nozzle clamp of claim 5, wherein the fastener includes a head portion defining a third cross-sectional diameter that is greater than the first cross-sectional diameter of the bore.

7. The nozzle clamp of claim 1, wherein the second surface of the body faces the bore of the arm.

8. The nozzle clamp of claim 1, wherein the nozzle clamp comprises steel;

wherein the fastener includes threads thereon, and the bore includes complementary threads therein, the threads on the fastener being configured to engage with the threads on the bore; and wherein the protrusion on the arm is a first protrusion, and the arm includes a second protrusion spaced from the first protrusion, the second protrusion being configured to contact the nozzle.

9. An applicator assembly for applying a material to a substrate, the applicator assembly comprising:

a housing;

a dispensing assembly configured to receive the material from a material source and to cause discharging of the material therefrom;

a nozzle configured to be affixed to the housing, the nozzle further being configured to receive the material from the dispensing assembly and to discharge the material from the nozzle; and a nozzle clamp configured to affix the nozzle to the housing, the nozzle clamp comprising:

a body defining a first surface configured to contact the housing and a second surface opposite the first surface;

an arm pivotally connected to the body, the arm being configured to move between a first position and a second position relative to the body, the arm comprising:

a bore extending therethrough; and a protrusion extending therefrom, the protrusion being configured to contact the nozzle; and a fastener movable within the bore of the arm, the fastener being configured to contact the second surface of the body, wherein the nozzle clamp is movable between a first configuration and a second configuration, wherein when the nozzle clamp is in the first configuration, the fastener is in contact with the second surface of the body, and the arm is precluded from being pivotally rotated relative to the body, and wherein when the nozzle clamp is in the second configuration, the fastener is not in contact with the second surface of the body, and the arm is permitted to be pivotally rotated relative to the body.

10. The applicator assembly of claim 9, further comprising a heater configured to heat the material being moved through the applicator assembly.

11. The applicator assembly of claim 9, wherein the nozzle clamp comprises steel.

12. The applicator assembly of claim 9, wherein the fastener includes threads thereon, and the bore includes complementary threads therein, the threads on the fastener being configured to engage with the threads on the bore.

13. The applicator assembly of claim 9, wherein the protrusion on the arm is a first protrusion, and the arm includes a second protrusion spaced from the first protrusion, the second protrusion being configured to contact the nozzle.

14. The applicator assembly of claim 9, wherein the bore defines a first cross-sectional diameter, the fastener defines a second cross-sectional diameter, and the second cross-sectional diameter is less than the first cross-sectional diameter.

15. The applicator assembly of claim 14, wherein the fastener includes a head portion defining a third cross-sectional diameter that is greater than the first cross-sectional diameter of the bore.

16. The applicator assembly of claim 9, wherein the second surface of the body faces the bore of the arm.

17. The applicator assembly of claim 9, wherein the nozzle clamp comprises steel;

wherein the fastener includes threads thereon, and the bore includes complementary threads therein, the threads on the fastener being configured to engage with the threads on the bore; and wherein the protrusion on the arm is a first protrusion, and the arm includes a second protrusion spaced from the first protrusion, the second protrusion being configured to contact the nozzle.

* * * * *